US005237370A

United States Patent [19]

Murai

[11] Patent Number: 5,237,370

[45] Date of Patent: Aug. 17, 1993

[54] IMAGE DENSITY CONTROL METHOD FOR IMAGE RECORDER

[75] Inventor: Kazuo Murai, Tokyo, Japan

[73] Assignee: Ricoh Company, Ltd., Tokyo, Japan

[21] Appl. No.: 790,487

[22] Filed: Nov. 12, 1991

[30] Foreign Application Priority Data

Nov. 13, 1990 [JP] Japan ..... 2-306711

[51] Int. Cl.[5] ..... G03G 21/00

[52] U.S. Cl. ..... 355/208; 355/246; 430/31

[58] Field of Search ..... 355/203, 204, 208, 245, 355/246, 77; 430/31; 364/148

[56] References Cited

U.S. PATENT DOCUMENTS 4,693,592 9/1987 Kurpan ..... 355/208
4,801,980 1/1989 Arai et al. ..... 355/246 X
4,833,506 5/1989 Kuru et al. ..... 355/208
4,975,747 12/1990 Higuchi ..... 355/246
5,012,430 4/1991 Sakurai ..... 364/148 X
5,084,754 1/1992 Tomitaka ..... 358/209
5,142,332 8/1992 Osawa et al. ..... 355/208

*Primary Examiner*—A. T. Grimley
*Assistant Examiner*—Sandra L. Brasé
*Attorney, Agent, or Firm*—Oblon, Spivak, McClelland, Maier & Neustadt

[57] ABSTRACT

An image density control method applicable to an electrophotographic copier or similar image recorder for controlling the toner concentration of a two-component developer, i.e., a mixture of toner and carrier to maintain the density of a toner image produced by the developer constant. Predetermined calculations are performed on the basis of the output of a photosensor which is responsive to the toner images representative of reference patterns formed on a photoconductive element.

7 Claims, 13 Drawing Sheets

Fig. 2

| | | R | dR | | TONER SUPPLY OUTPUT |
|---|---|---|---|---|---|
| RULE | [I] | SMALL | ZR | ⇨ | SMALL |
| RULE | [II] | MEDIUM | ZR | ⇨ | MEDIUM |
| RULE | [III] | LARGE | ZR | ⇨ | LARGE |
| RULE | [IV] | SMALL | BELOW NM | ⇨ | ZERO |
| RULE | [V] | SMALL | PM | ⇨ | MEDIUM |
| RULE | [VI] | SMALL | PL | ⇨ | LARGE |
| RULE | [VII] | MEDIUM | NM | ⇨ | SMALL |
| RULE | [VIII] | MEDIUM | NL | ⇨ | ZERO |
| RULE | [IX] | MEDIUM | ABOVE PM | ⇨ | LARGE |
| RULE | [X] | LARGE | NM | ⇨ | MEDIUM |
| RULE | [XI] | LARGE | NL | ⇨ | SMALL |
| RULE | [XII] | LARGE | ABOVE PM | ⇨ | LARGE |
| RULE | [XIII] | MINIMUM | | ⇨ | ZERO |
| RULE | [XIV] | MAXIMUM | | ⇨ | ZERO |

Fig. 6

| | R | dR | | TONER SUPPLY OUTPUT | INTERVAL BETWEEN TONER IMAGE FORMATION |
|---|---|---|---|---|---|
| RULE [I] | SMALL | ZR | ⇨ | SMALL | P |
| RULE [II] | MEDIUM | ZR | ⇨ | MEDIUM | P |
| RULE [III] | LARGE | ZR | ⇨ | LARGE | P |
| RULE [IV] | SMALL | NM | ⇨ | ZERO | Z |
| RULE [V] | SMALL | NL | ⇨ | ZERO | N |
| RULE [VI] | SMALL | PM | ⇨ | MEDIUM | Z |
| RULE [VII] | SMALL | PL | ⇨ | LARGE | N |
| RULE [VIII] | MEDIUM | NM | ⇨ | SMALL | Z |
| RULE [IX] | MEDIUM | NL | ⇨ | ZERO | N |
| RULE [X] | MEDIUM | PM | ⇨ | LARGE | Z |
| RULE [XI] | MEDIUM | PL | ⇨ | LARGE | N |
| RULE [XII] | LARGE | NL | ⇨ | SMALL | N |
| RULE [XIII] | LARGE | NM | ⇨ | MEDIUM | Z |
| RULE [XIV] | LARGE | PM | ⇨ | LARGE | Z |
| RULE [XV] | LARGE | PL | ⇨ | LARGE | N |
| RULE [XVI] | MAXIMUM | ALL | ⇨ | ZERO | N |
| RULE [XVII] | MINIMUM | ALL | ⇨ | ZERO | N |

Fig. 10

| | | R | dR | iR | | TONER SUPPLY OUTPUT | INTERVAL BETWEEN TONER IMAGE FORMATION | ERROR COUNT |
|---|---|---|---|---|---|---|---|---|
| RULE | [I] | ALL | ZR | ALL | ⇨ | R | P | 0 |
| RULE | [II] | SMALL | NL | ALL | ⇨ | ZERO | N | 0 |
| RULE | [III] | SMALL | NM | ALL | ⇨ | ZERO | Z | 0 |
| RULE | [IV] | SMALL | PM | ALL | ⇨ | MEDIUM | Z | 0 |
| RULE | [V] | SMALL | PL | ZorN | ⇨ | MEDIUM | N | 0 |
| RULE | [VI] | SMALL | PL | P | ⇨ | LARGE | N | 0 |
| RULE | [VII] | MEDIUM | NM | ALL | ⇨ | SMALL | Z | 0 |
| RULE | [VIII] | MEDIUM | NL | ZorP | ⇨ | SMALL | N | 0 |
| RULE | [IX] | MEDIUM | NL | N | ⇨ | ZERO | N | 0 |
| RULE | [X] | MEDIUM | PM | ALL | ⇨ | LARGE | Z | 0 |
| RULE | [XI] | MEDIUM | PL | ALL | ⇨ | LARGE | N | 0 |
| RULE | [XII] | LARGE | NM | ALL | ⇨ | MEDIUM | Z | 0 |
| RULE | [XIII] | LARGE | NL | ZorP | ⇨ | MEDIUM | Z | 0 |
| RULE | [XIV] | LARGE | NL | N | ⇨ | SMALL | N | 0 |
| RULE | [XV] | LARGE | PM | ALL | ⇨ | LARGE | Z | 0 |
| RULE | [XVI] | LARGE | PL | ALL | ⇨ | LARGE | N | 0 |
| RULE | [XVII] | MAXIMUM | ALL | ALL | ⇨ | ZERO | N | +1 |
| RULE | [XIIIV] | MAXIMUM | ALL | ALL | ⇨ | ZERO | N | +1 |

IMAGE DENSITY CONTROL METHOD FOR IMAGE RECORDER

BACKGROUND OF THE INVENTION

The present invention relates to a method applicable to an electrophotographic copier or similar image recorder for controlling the density of an image in such a manner as to maintain it constant at all times.

In the above-described type of image recorder, a latent image electrostatically formed on an image carrier by a predetermined procedure is developed by a toner, i.e., colored fine particles fed from a developing device. The toner is usually charged to the opposite polarity to the latent image and electrostatically deposited on the latent image. To charge the toner to such a polarity, it may be combined with a carrier to constitute a two-component developer and agitated together with the carrier for frictional charging. While this kind of development using a two-component developer is capable of charging the toner sufficiently, the toner concentration sequentially decreases since only the toner is consumed during development. Therefore, the toner concentration of the developer, i.e., the density of an image to be developed by the toner has to be controlled to a predetermined value. This may be done by measuring the current toner concentration of the developer and, based on the measured toner concentration, controlling the amount of toner supply, i.e., the amount of toner to be fed to the carrier.

The toner concentration of the developer may be directly determined in terms of the weight or the permeability of the developer. Such direct measurement may be replaced with indirect measurement which uses a white reference pattern and a black reference pattern. Specifically, for the indirect measurement, latent images representative of a white and a black reference pattern are electrostatically formed on a photoconductive element and developed by a developer. The densities of the resulting toner images are measured by a photoelectric arrangement. More specifically, a photosensor or so-called P sensor is located in close proximity to the surface of the photoconductive element to sense the densities of the toner images of the reference patterns, so that a particular amount of toner supply is selected on the basis of the ratio of the sensed densities. This kind of scheme, therefore, determines a change in the density of each toner image of interest in terms of a change in the toner concentration of the developer, i.e., the mixture ratio of toner and carrier. An electrophotographic copier, for example, using such a method effects the measurement once every time ten copies are produced.

The conventional control method using a P sensor as stated above has the following problems left unsolved.

(1) Since the toner supply begins only after the toner concentration has lowered, the toner concentration sharply changes when documents of the kind consuming much toner are continuously copied, preventing the toner concentration from remaining constant.

(2) Since no consideration is given to the interval between the supply of toner and the resulting increase in toner concentration, the toner concentration is scattered over a broad range, i.e., the control accuracy is not satisfactory.

(3) Toner images representative of the reference patterns are formed once per ten copies without exception, as stated earlier. Hence, when a document of the kind consuming a relatively small amount of toner is copied a plurality of times, it is likely that a greater amount of toner is consumed by the toner images of the reference patterns than by the images of the document. On the other hand, when documents to be sequentially copied are of the kind consuming a great amount of toner, the conventional control method cannot accurately follow the change in the amount of toner.

SUMMARY OF THE INVENTION

It is, therefore, an object of the present invention to provide an image density control method which insures a stable image density by eliminating sharp changes in toner concentration.

It is another object of the present invention to provide an image density control method which reduces the scattering in toner concentration by taking account the interval between the supply of toner and the resulting increase in toner concentration, thereby enhancing accurate image density control.

It is another object of the present invention to provide an image density control method which consumes a minimum amount of toner.

It is another object of the present invention to provide an image density control method which is performs stable control without regard to the amount of toner consumed for documents.

In accordance with the present invention, in an image density control method for forming toner images representative of reference patterns on a photoconductive element, detecting a value of the toner images relating to an image density by predetermined detecting means, and controlling an image density on the basis of the value, an image density is controlled on the basis of at least two of a first value proportional to a deviation of the value relating to an image density, a second value proportional to the size and duration of the value, and a third value proportional to a rate of change of the value.

BRIEF DESCRIPTION OF THE DRAWINGS

The above and other objects, features and advantages of the present invention will become more apparent from the following detailed description taken with the accompanying drawings in which:

FIG. 2 shows rules particular to the first embodiment;

FIG. 6 shows rules particular to the second embodiment;

FIG. 10 shows rules particular to the third embodiment;

DESCRIPTION OF THE PREFERRED EMBODIMENTS

Figure 1:
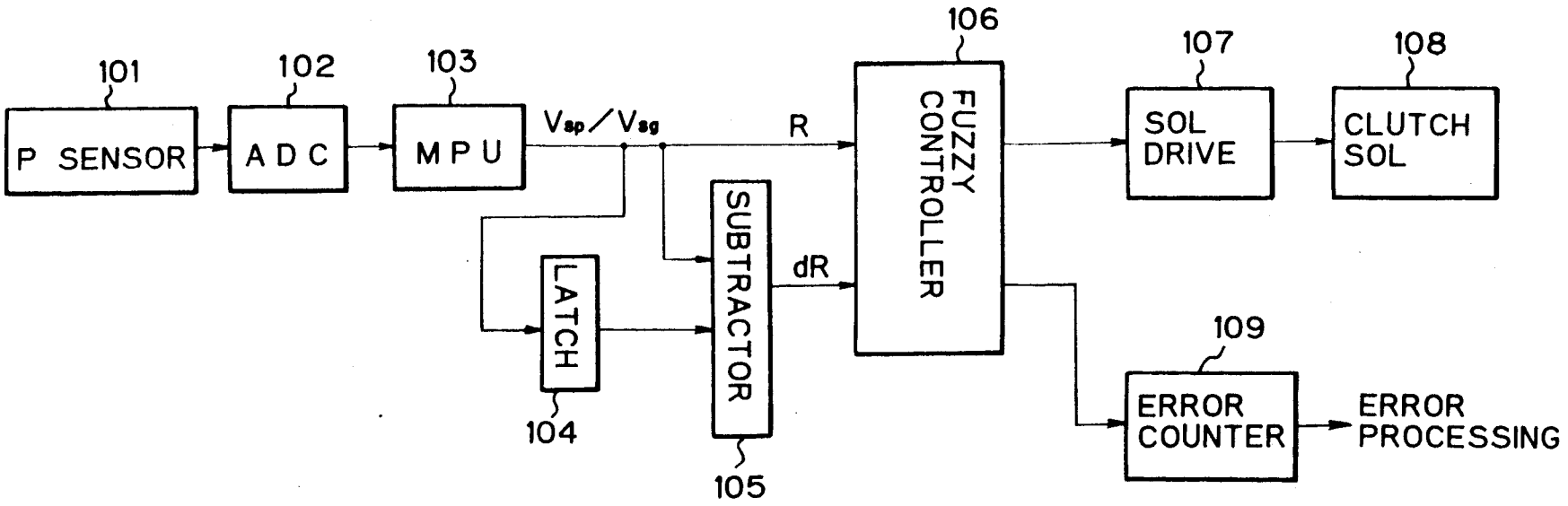
FIG. 1 is a block diagram schematically showing a control device for practicing a first embodiment of the image density control method of the present invention.

To better understand the present invention, a brief reference will be made to a copier using a conventional image density control method, shown in FIG. 11. As shown, the copier has a glass platen 401 on which a document, not shown, is laid. An image printed on the document is focused onto the surface of a photoconductive drum 406 via a first mirror 402, a second mirror 403, an in-mirror lens 404, and a third mirror 405. The mirrors 402 and 403 are driven to the left at a predetermined speed in synchronism with the rotation (counterclockwise as viewed in the figure) of the drum 406. A latent image electrostatically formed on the drum 406 is developed by a developer deposited on a developing roller 407*a* which is included in a developing device 407. The developer is made up of a toner and a carrier. The resulting toner image on the drum 406 is transferred to a recording medium, or paper sheet, by a transfer charger 408. The paper sheet with the toner image is transported to a fixing station, not shown, by a belt 409. Reference patterns which are a white pattern $P_0$ and a black pattern $P_1$ are positioned in a projection field where the home position of the first mirror 402 is defined. As the mirror 402 is moved to the left for scanning the document, latent images representative of the white pattern $P_0$ and black pattern $P_1$ are electrostatically formed on the drum 406 in succession.

A photosensor or so-called P sensor 410 is interposed between the deveoping device 407 and the transfer charger 408 to sense the density of a toner image formed on the drum 406. The output of the P sensor 410 is amplified and shaped in waveform by an amplifier 411 and then applied to an analog-to-digital converter (ADC) 412. The resulting digital output of the ADC 412 is fed to a microprocessor (MPU) 413. The MPU 413 calculates the ratio of toner images representative of the reference patterns $P_0$ and $P_1$, i.e., Vsp/Vsg and determines an amount of toner to be supplied on the basis of the calculated ratio. Specifically, during a period of time matching the amount of toner supply, the MPU 413 delivers a turn-on command to a solenoid driver 414. In response, the solenoid driver 414 energizes a clutch solenoid 415 with the result that a toner supply roller 416 is rotated to feed a toner from a reservoir to the developing device 407.

Figure 11:
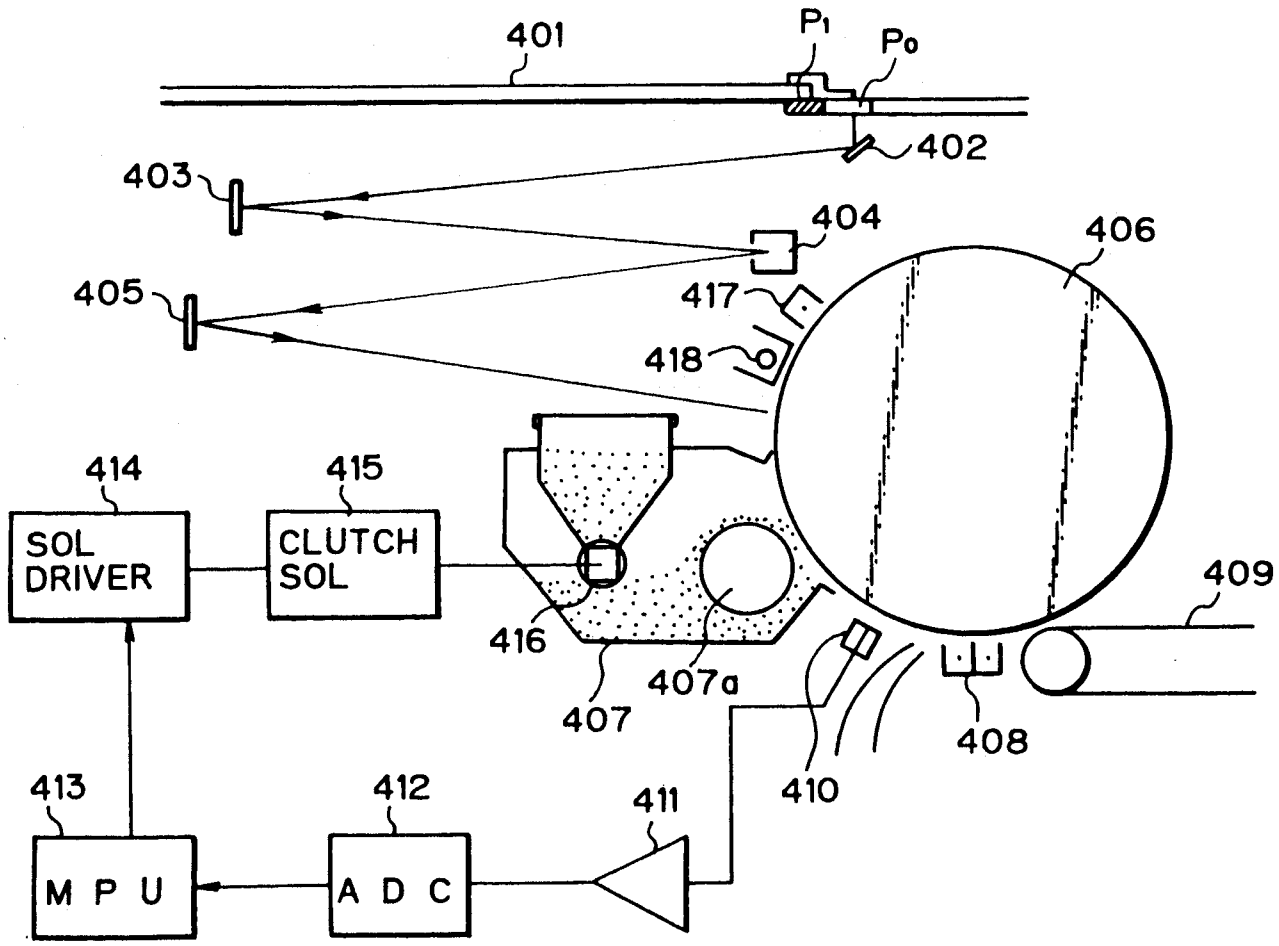
Fig. 11 PRIOR ART
FIG. 11 shows an electrophotographic copier using a conventional image densisty control method.

There are also shown in FIG. 11, a main charger for uniformly charging the surface of the drum 406, and an erase lamp 418 for discharging a predetermined area of the charged surface of the drum 406 to which the reference patterns $P_0$ and $P_1$ are to be projected. The erase lamp 417 is controllably turned on such that the latent images of the reference patterns $P_0$ and $P_1$ are formed on the drum 406 once per ten copies, the P sensor 410 sensing the densities of the resulting toner images.

Figure 12A:
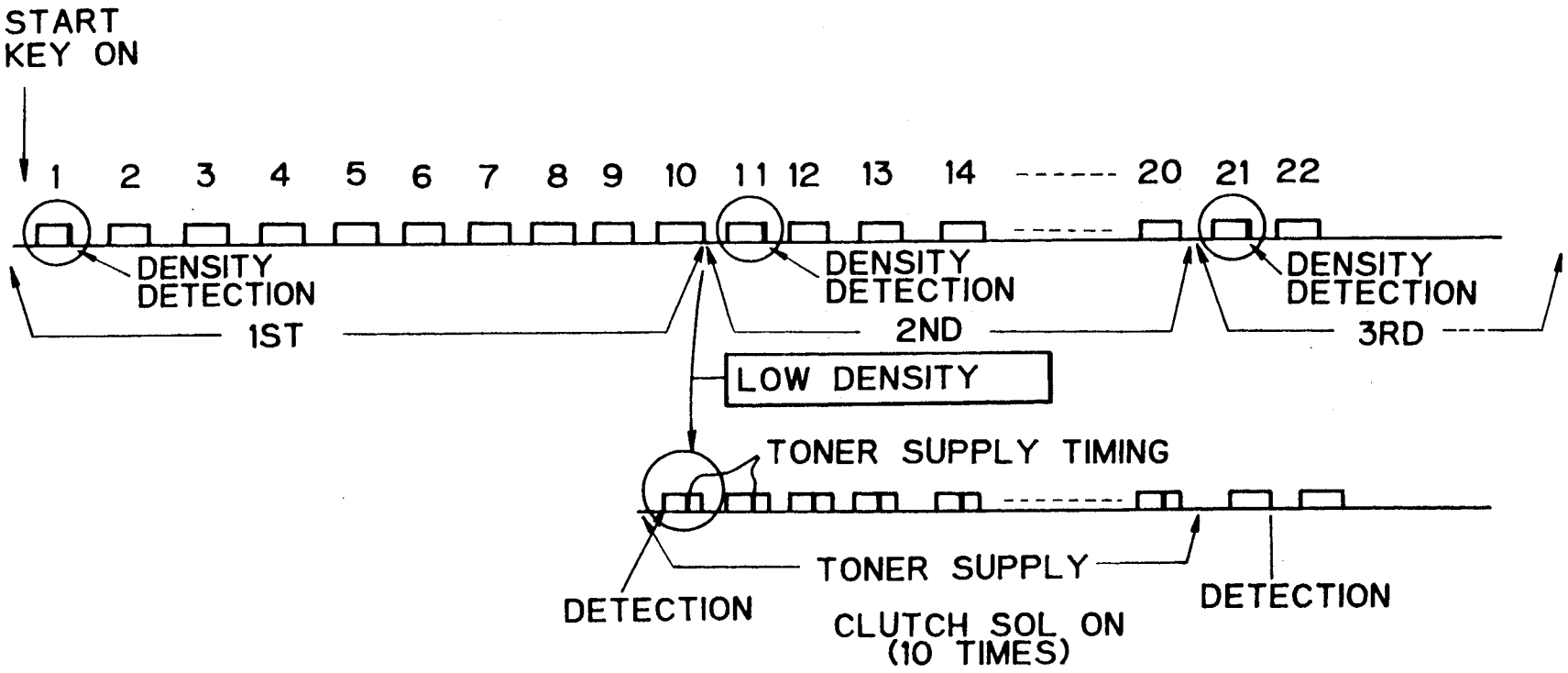
Fig. 12A PRIOR ART
FIGS. 12A–12E demonstrate the conventional image density control method.

A reference will be made to FIGS. 12A–12E for describing the conventional image density control method. The method using the P sensor 410 determines a change in toner concentration, i.e., the mixture ratio of toner and carrier in terms of changes in the densities of the reference pattern images and controls the image density by supplying an adequate amount of toner matching the change in toner concentration. As shown in FIG. 12A, the image density is sensed when the first copy is produced after the turn-on of a start key and every time ten copies are produced thereafter. When the image density is low as determined by the MPU 413, the clutch solenoid 415 is turned on and then turned off for each of ten copies until the next time for sensing the toner density, thereby continuously supplying the toner via the toner supply roller 416. On the other hand, the erase lamp 417 is turned off when the image density should be sensed, whereby the latent images of the white pattern $P_0$ and black pattern $P_1$ are formed on the drum 406. As the toner images representative of the reference patterns $P_0$ and $P_1$ arrive at the P sensor 410, the sensor 410 turns on light emitting diodes to illuminate such toner images and receives reflections from the toner images to determine their densities.

Figure 12B:
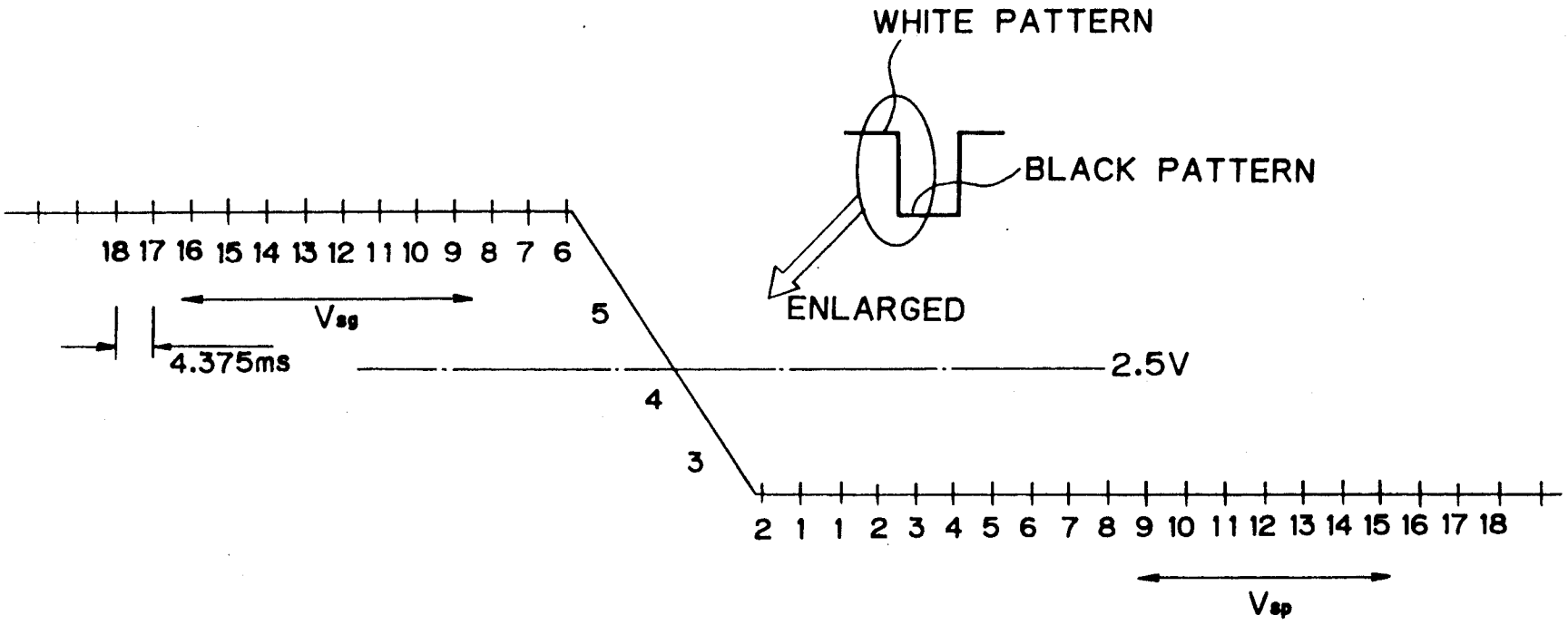
Fig. 12B PRIOR ART
Figure 12C:
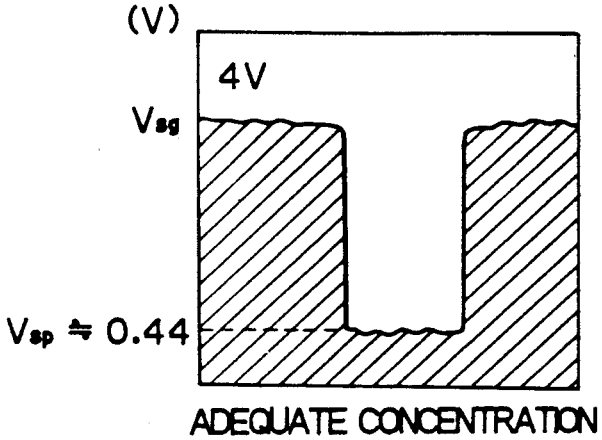
Fig. 12C PRIOR ART
Figure 12D:
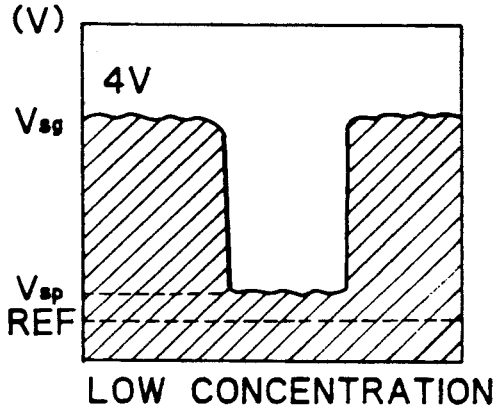
Fig. 12D PRIOR ART.
Figure 12E:
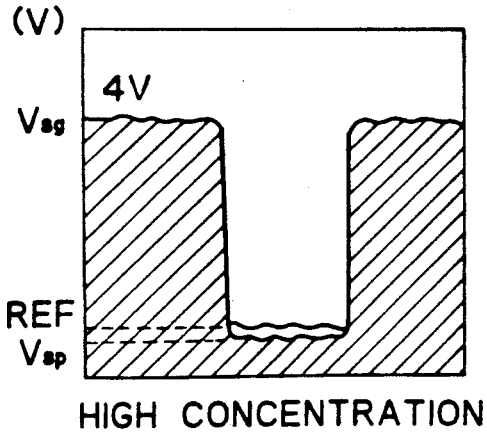
Fig. 12E PRIOR ART

As shown in FIG. 12B, when the toner density is low (representative of white pattern $P_0$), the reflection is intense so that the output of the P sensor 410 is a large value. Conversely, when the toner density is high (representative of black pattern $P_1$), the output of the P sensor 410 has a small value since the reflection is not intense. The MPU 413 averages 9–16 having appeared before the input data from the P sensor 410 lowers to below 2.5 volts four consecutive times, thereby producing Vsg. To produce Vsp, the MPU 413 averages 9–16 having appeared after the input data from the P sensor 410 lowers to below 2.5 volts four consecutive times. As shown in FIG. 12C, assume that Vsg is 4 volts, and that Vsp is about 0.44 volt so long as the toner concentrations of the developer is adequate. Then, as the toner concentration lowers, the density of the toner image on the drum 406 also lowers. As a result, as shown in FIG. 12D, Vsp becomes higher than 0.44 volt. When the toner concentration is high, Vsp becomes lower than 0.44 volt since the density of the toner image increases, as shown in FIG. 12E. It is possible, therefore, to determine whether or not to supply the toner on the basis of Vsp. In practice, since Vsg is not always 4 volts, the toner supply is controlled on the basis of a reference ratio Vsp/Vsg=1/9 (nearly equal to 0.44/4).

The conventional image density control method described above has the previously discussed problems (1)–(3).

Preferred embodiments of the present invention will be described hereinafter.

FIRST EMBODIMENT

Referring to FIG. 1, an image density control device for practicing a first embodiment of the present invention is shown. As shown, the control device has a photosensor or P sensor 101 for sensing the density of each toner image representative of a reference pattern, i.e., a value relating to the image density. An ADC 102 converts the output of the P sensor 101. The resulting digital value relating to the image density is applied to an MPU 103 which then produces a ratio Vsp/Vsg (=R). A latch 104 latches the output of the MPU 103. A subtractor 105 produces a difference dR between the content of the latch 104 (immediately preceding R) and the current R from the MPU 103. A fuzzy controller 106 controls the amount of toner supply or executes error processing, in response to R and dR fed thereto from the MPU 103 and subtractor 105, respectively. A solenoid driver 107 energizes a clutch solenoid 108 a particular period of time in response to a toner supply signal from the fuzzy controller 106. An error counter 109 counts errors which the fuzzy controller 106 produces by error processing.

Figure 3A:
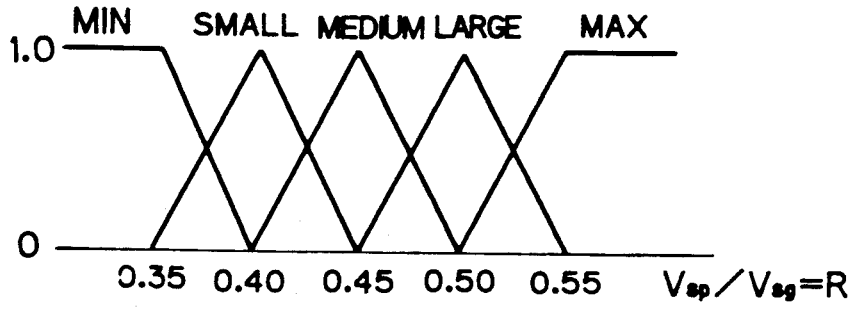
FIGS. 3A-3C show membership functions particular to the first embodiment.
Figure 3B:
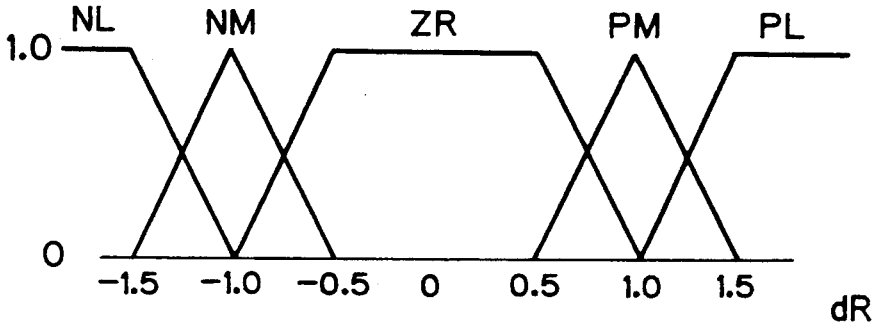
Figure 3C:
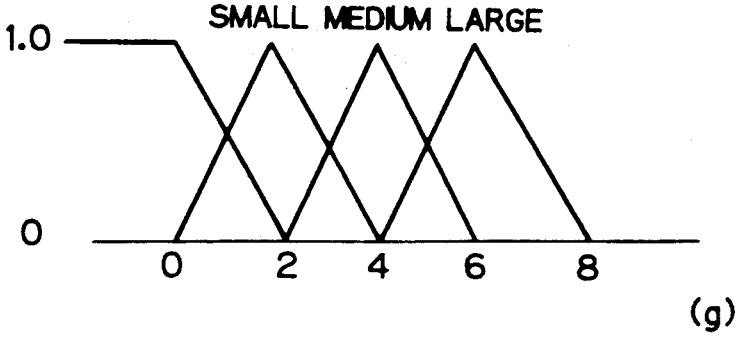

In operation, assume that control device, like the conventional one, senses the toner image density, once every ten copies, i.e., causes the formation of toner images representative of the reference patterns on a photoconductive drum once per ten copies. To begin with, the ADC 102 converts the densities of the toner images of interest sesed by the P sensor 101 to digital values, and the MPU 103 calculates Vsp/Vsg. Vsp/Vsg from the MPU 103 is fed to the fuzzy controller 106 together with a difference dR between Vsp/Vsg=R and the immediately preceding R (content of latch 104). In response, the fuzzy controller 106 executes toner supply processing or error processing according to the rules shown in FIG. 2. The fuzzy controller 106 has membership functions shown in FIGS. 3A, 3B and 3C and assigned to R, dR, and toner supply output, respectively.

Figure 4:
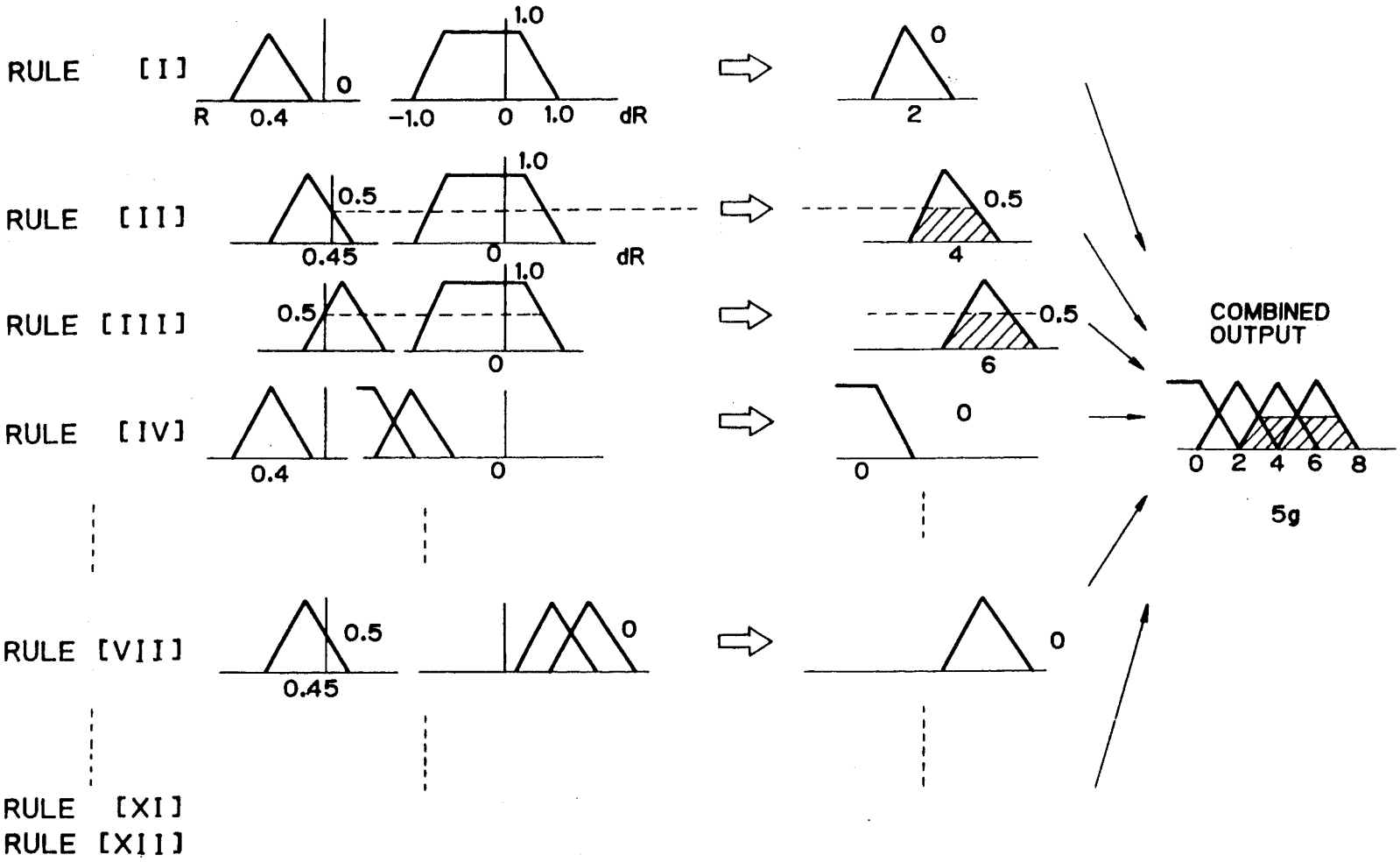
FIG. 4 demonstrates the operation of the first embodiment.

Specifically, assuming R=0.475 and dR=0.025, the fuzzy controller 106 determines an amount of toner supply, as shown in FIG. 4, according to the rules shown in FIGS. 2 and 3A-3C. First, the fuzzy controller 106 produces the values of the points where R=0.475 intersects the membership functions of the respective rules shown in FIG. 3A (zero if the former does not intersect the latter). Then, the fuzzy controller 106 calculates the values of the points of intersection associated with the respective rules shown in FIG. 3B. Thereafter, the fuzzy controller 106 determines the minimum one of the calculated values of the points of intersection associated with each rule. As a result, the fuzzy controller 106 obtains zero from rule [I], 0.5 from rule [II], 0.5 from rule [III], and zero from rules [IV]-[XIV]. Subsequently, the fuzzy controller 106 determines the values of toner supply output membership functions (shown in FIG. 3C) corresponding to the above-mentioned values. In this example, there are obtained an area defined by the values of toner supply outputs "medium" and "large" which are smaller than 0.5 on the basis of the rules [II] and [III], as indicated by hatching in FIG. 4 (the rest being zero). The outputs based on the rules [I]-[XIV] are added together to produce a trapezoid, as shown at the right-hand side in FIG. 4. Finally, the fuzzy controller 106 determines an amount of toner supply by defuzzy processing. Generally, defuzzy processing is executed by calculating the center of gravity of the combined output. In this example, the fuzzy controller 106 outputs 5g by the defuzzy processing. By using 5g, the fuzzy controller 106 turns on the solenoid driver 107, i.e., the clutch solenoid 108 for each copy so as to supply the determined amount of toner. Further, in the case of rules [XIII] and [XIV] (R being the maximum or the minimum), the error counter 109 is incremented by 1 (one). As the error counter 109 is incremented three consecutive times, error processing is executed to stop the toner supply while displaying the error.

As stated above, the illustrative embodiment uses a difference dR to promote more accurate density control than in the case with R only. Especially, the embodiment remarkably enhances accurate density control when the density is sharply changed. Moreover, when, for example, the image area ratio of a document is not constant or when the supply of toner is not immediately reflected by the toner density, the embodiment approximates such a factor which cannot be readily defined by a control function by using fuzzy reasoning using membership functions. This is successful in promoting firm image density control.

While the MPU 103, fuzzy controller 106, latch 104 and subtractor 105 are shown and described as comprising independent units, the embodiment is, of course, practicable even when all such functions are implemented by software and assigned to MPU. It is to be noted that at the instant when the power source is turned on, no values are latched in the latch 104 and, therefore, dR is apt to have a great value. In such a condition, it is necessary to control the density only by R or to store the existing value immediately before the turn-off of the power source by a back-up battery and latch it on the turn-on of the power source.

SECOND EMBODIMENT

Figure 5:
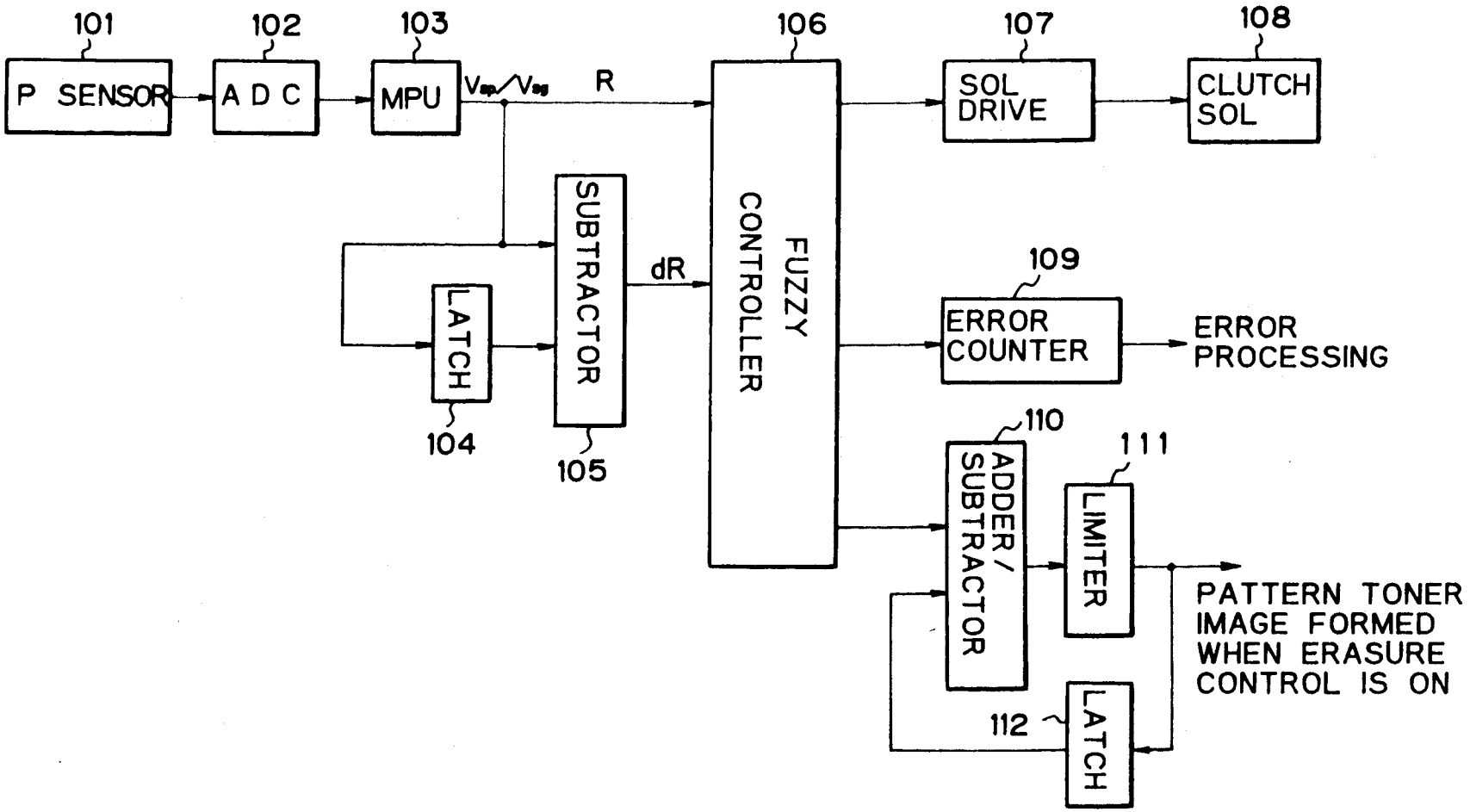
FIG. 5 is a block diagram schematically showing a second embodiment of the present invention.

Referring to FIG. 5, a second embodiment of the present invention is shown and has an erasure control section made up of an adder/subtractor 110, a limiter 111 and a latch 112, in addition to the construction of the first embodiment, FIG. 1. The rest of the construction will not be described to void redundancy.

Figure 7A:
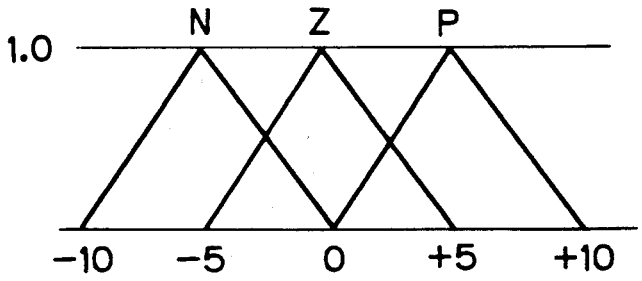
FIG. 7A shows membership functions particular to the second embodiment.
Figure 7B:
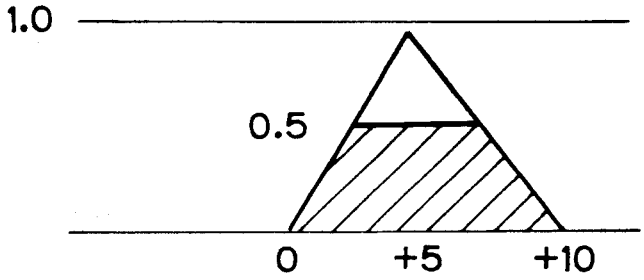
FIG. 7B shows a combined output.

In this particular embodiment, the erase control section controls the number of times that the toner concentration should be sensed, i.e., the number of times that toner images representative of the reference patterns should be formed on the photoconductive element. FIG. 7A shows membership functions assigned to the number of times of formation of the toner images, while FIG. 6 shows rules associated therewith. Assuming that R=0.475 and dR=0.025 by way of example, 5g is outputted as an amount of toner supply, as in the first embodiment. In this case, among the rules [I]-[XVII], the rules [II] and [III] match so that the interval between the successive formation of toner patterns is P based on rules [II] and [III] and zero based on the other rules. As a result, a combined output shown in FIG. 7B and, therefore, a defuzzy output of +5 is produced. Then, the adder/subtractor 110 outputs the sum of the immediately preceding interval (content of latch 112) and 5. Assuming that the immediately preceding interval is 10, meaning that the toner images of interest were formed once per ten times last time, then they will be formed once per 15 copies this time. The output of the adder/subtractor 110 has a maximum value of 20 and a minimum value of 5 as limited by the limiter 111. Hence, when the adder/subtractor 110 produces a value greater than 20 or a value smaller than 5, the latch 112 stores 20 or 5.

In this manner, in portions where the change is not noticeable, the embodiment increases the interval between the successive formation of toner images to thereby save the toner. Conversely, in portions where the change is noticeable, the embodiment reduces the interval to enhance accurate toner supply control.

In this embodiment, it is necessary to set the above-stated interval at, for example, ten copies and latch it at the time when the power source is turned on.

THIRD EMBODIMENT

Figure 9:
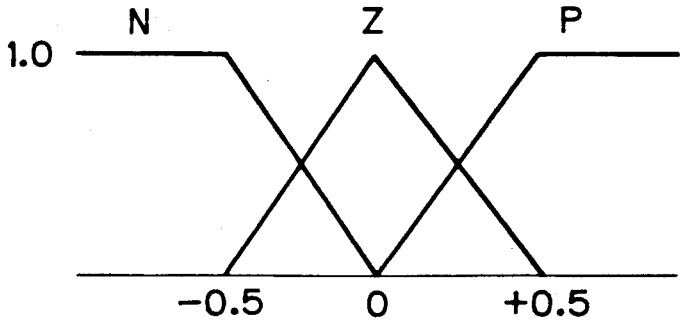
FIG. 9 shows membership functions particular to the third embodiment.
Figure 8:
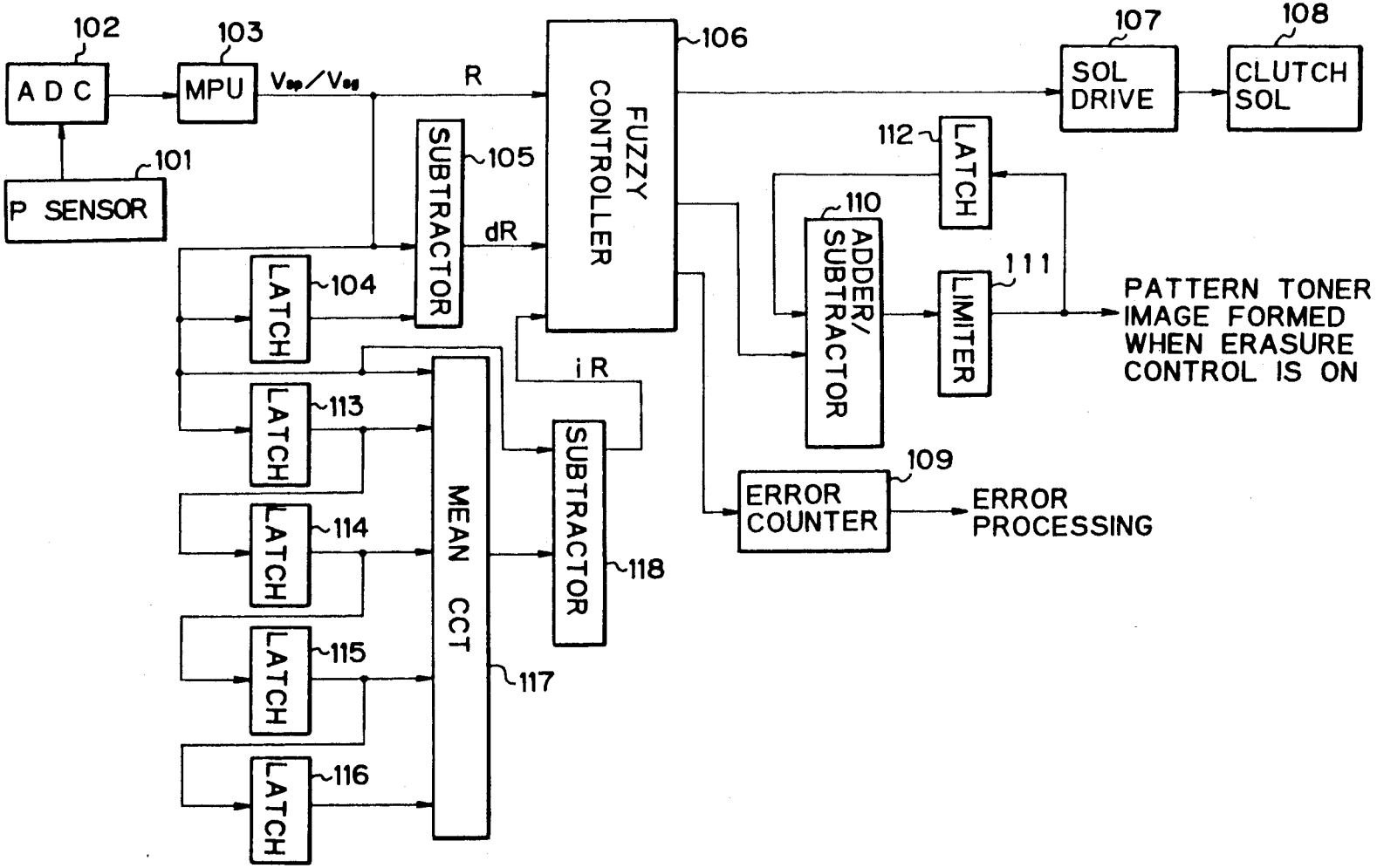
FIG. 8 is a block diagram schematically showing a third embodiment of the present invention.

FIG. 8 shows a third embodiment of the present invention which is similar to the second embodiment except that it additionally has latches 113-116, a mean circuit 117, and a subtractor 118. The following description will concentrate only on the components which are particular to this embodiment. Regarding the fuzzy controller 106, it is identical with that of the second embodiment except that it receives an additional input iR. This input iR is produced by latching four consecutive Rs preceeded the current R input, then averaging five Rs in total, and then subtracting the resulting means value from the current value. FIG. 9 shows membership functions for inputting iR while FIG. 10 shows rules associated therewith.

Specifically, as shown in FIG. 10, assume that R matching rules [VIII] and [IX] is "medium", and that dR is NL (e.g. when the current R is 0.45 and the immediately preceding R is 0.6). In such a case, the second embodiment would fully interrupt the toner supply. By contrast, this embodiment determines, when the mean value of the previous values is greater than the current value, i.e., when it is smaller than "medium", that the above-mentioned value 0.6 is erroneous and makes the toner supply output rule [VIII] "small"; when the difference of mean value is greater than N, i.e., "medium" of mean values, stops the toner supply by the rule [IX], as in the second embodiment, determining that the toner consumption is rapid. This is successful in further enhancing accurate control. While this embodiment simplifies the rules by using a difference as iR, it is also practicable with a mean value itself. Then,

| | R | dR | iR |
|---|---|---|---|
| rule [VIII] | medium | NL | below "medium" |
| in rule [IX] | medium | NL | above "medium" |

In summary, it will be seen that the present invention provides an image density control method which insures stable toner concentration by eliminting sharp changes in toner concentration, enhances accurate control by reducing the range of scattering in toner concentration by taking account of the interval between the supply of toner and the resulting increase in toner concentration, reduces the amount of toner to be consumed by image density control, and performs toner concentration control stably at all times with no regard to the toner consumption association with documents.

Various modifications will become possible for those skilled in the art after receiving the teachings of the present disclosure without departing from the scope thereof.

What is claimed is:

1. An image density control method for forming toner images representative of reference patterns on a photoconductive element comprising the steps of:

detecting a value of said toner images relating to an image density by predetermined detecting means;

computing a first value proportional to a deviation of said detected value relating to image density;

computing a second value proportional to the size and deviation of said detected value;

computing a third value proportional to a rate of change of said detected value; and controlling an image density on the basis of said detected value, wherein said image density is controlled on the basis of at least two of said first, second and third values.

2. A method as claimed in claim 1, wherein said controlling is accomplished by use of fuzzy reasoning using membership functions in response to at least two of said first, second and third values.

3. A method as claimed in claim 1, wherein said formation step further comprises the step of:

forming the images of said reference patterns on said photoconductive element at predetermined times.

4. A method as in claim 3 further comprising the step of:

controlling said predetermined times on the basis of at least two of said first, second and third values.

5. A method as in claim 3 further comprising the step of controlling said predetermined times by fuzzy reasoning using membership functions in response to at least two of said first, second and third values.

6. An image density control apparatus comprising:

image forming means for electrostatically forming a latent image representative of a reference pattern on a photoconductive element;

developing means for developing the latent image by a toner to produce a corresponding toner image;

toner supplying means for supplying the toner to said developing means;

sensing means for sensing a density of a current toner image and an immediately preceding toner image each being representative of the reference pattern; and fuzzy control means for determining an amount of toner supply by adding amounts of toner supply associated with the current toner image and the immediately preceding toner image sensed by said sensing means and on the basis of rules relating to the current toner image, the immediately preceding toner image, and the amount of toner supply.

7. An image density control apparatus comprising:

image forming means for electrostatically forming a latent image representative of a reference pattern on a photoconductive element;

developing means for developing the latent image by a toner to produce a corresponding toner image;

toner supplying means for supplying the toner to said developing means;

sensing means for sensing a density of the toner image;

latching means for latching a density of an immediately preceding toner image representative of the reference pattern; and fuzzy control means for determining an amount of toner supply by adding an amount of toner supply associated with the current toner image and an amount of toner supply associated with the immediately preceding toner image and latched by said latching means and which are sensed by said sensing means, on the basis of rules relating to the current toner image, the immediately preceding toner image, and an amount of toner supply.

* * * * *